US007934618B2

(12) United States Patent
Sued et al.

(10) Patent No.: US 7,934,618 B2
(45) Date of Patent: May 3, 2011

(54) BAG SECURING MECHANISM, COMPONENT, KIT, AND COMBINATION AND METHOD OF SECURING A SHREDDER BAG

(76) Inventors: Charles Sued, Brooklyn, NY (US); Aron Abramson, Brooklyn, NY (US)

( * ) Notice: Subject to any disclaimer, the term of this patent is extended or adjusted under 35 U.S.C. 154(b) by 484 days.

(21) Appl. No.: 12/041,653

(22) Filed: Mar. 3, 2008

(65) Prior Publication Data

US 2009/0218352 A1 Sep. 3, 2009

(51) Int. Cl.
*B65D 25/14* (2006.01)

(52) U.S. Cl. ..... 220/495.08

(58) Field of Classification Search ..... D18/34.4, D18/34.3, 34.1; 248/100, 99, 95; 24/303, 24/304, 545, 546, 570; 220/482, 481, 480, 220/735, 694, 495.01, 9.3, 9.2, 9.1, 720, 220/4.33, 428, 666
See application file for complete search history.

(56) References Cited

U.S. PATENT DOCUMENTS

| | | | | |
|---|---|---|---|---|
| 3,682,402 | A | 8/1972 | Goldhammer | |
| 4,558,800 | A * | 12/1985 | Isgar et al. | 220/495.1 |
| 4,664,347 | A * | 5/1987 | Brown et al. | 248/97 |
| 5,222,704 | A * | 6/1993 | Light | 248/100 |
| 5,803,299 | A * | 9/1998 | Sealy, Jr. | 220/495.07 |
| 6,820,830 | B1 | 11/2004 | Lassen et al. | |
| 6,962,301 | B1 | 11/2005 | Chang | |
| 2004/0182866 | A1 | 9/2004 | Carrillo | |
| 2005/0129335 | A1 | 6/2005 | Paul | |
| 2006/0091247 | A1 | 5/2006 | Matlin | |
| 2007/0029420 | A1 | 2/2007 | Radstrom et al. | |

* cited by examiner

*Primary Examiner* — Anthony Stashick
*Assistant Examiner* — Robert J Hicks
(74) *Attorney, Agent, or Firm* — Garcia-Zamor IP Law; Ruy M. Garcia-Zamor

(57) ABSTRACT

Mechanisms, components, kits, combinations, and methods of securing shredder bags to shredder baskets that allows at least a portion of a top edge of a shredder basket to not be overlapped by a shredder bag. One preferred embodiment of a bag securing component may include a plurality of securing components each having lateral sides, the plurality of securing components may be detachably engaged in a side-by-side fashion to form a one piece member that may be reducible in length.

14 Claims, 6 Drawing Sheets

BAG SECURING MECHANISM, COMPONENT, KIT, AND COMBINATION AND METHOD OF SECURING A SHREDDER BAG

BACKGROUND

The present invention is generally directed to shredders and, more specifically, to mechanisms, components, kits, combinations, and methods of securing shredder bags to shredder baskets.

Conventional shredders typically have shredder baskets receive shredded material without the use of a shredder bag. However, this complicates the debris removal process and can result in spilled debris when emptying the shredder basket into a bag. To reduce the potential mess associated with operating a shredder without a shredder bag, some users place a shredder bag in the shredder basket and overlap the bag over the entire upper edge of the shredder bag in a manner similar to that used with regular trash receptacles. However, this method has the disadvantage of looking sloppy, unprofessional, and interrupting the aesthetic of the shredder housing by having edges of the shredder bag protruding between the top of the shredder basket and the rest of the shredder.

It may be advantageous to provide mechanisms, components, kits, combinations, and methods of securing shredder bags to shredder baskets that allows at least a portion of a top edge of a shredder basket to not be overlapped by a shredder bag.

SUMMARY

Briefly speaking, one preferred embodiment of the present invention is directed to a bag securing mechanism adapted for use with a shredder basket including a plurality of securing components each having lateral sides. The plurality of securing components are detachably engaged in a side-by-side fashion to form a one piece member that is reducible in length. Each securing component includes a first plate adapted to be engaged with the shredder basket. A hook positioned on the first plate that includes a lip that is adapted to receive a portion of a shredder bag thereover. The bag securing mechanism is adapted for placement on at least one side of the shredder basket to secure a portion of the shredder bag thereto.

In a separate aspect, the present invention is directed to a kit for use with a shredder basket including at least one shredder bag adapted for use with the shredder basket. The kit also includes a bag securing mechanism including a plurality of securing components each having lateral sides. The plurality of securing components are detachably engaged in a side-by-side fashion to form a one piece member that is reducible in length. Each securing component includes a first plate. Adhesive is positioned on the first plate so that the first plate is adapted to be engaged with the shredder basket. A hook is positioned on the first plate that includes a lip that is adapted to receive a portion of a shredder bag thereover. The bag securing mechanism is adapted for placement on at least one side of the shredder basket to secure a portion of the shredder bag thereto.

In a separate aspect, the present invention is directed to a securing component adapted for use with a shredder basket including a first plate. Adhesive is positioned on the first plate so that the first plate is adapted to be engaged with the shredder basket. A hook is positioned on the first plate and includes a lip that is adapted to receive a portion of a shredder bag thereover. The securing component is adapted for placement on at least one side of the shredder basket to secure a portion of the shredder bag thereto.

In a separate aspect, the present invention is directed to a method of securing at least a portion of a shredder bag to a shredder basket. The method includes the steps of: providing the shredder basket; providing a bag securing mechanism having a length that is adjustable, the bag securing mechanism being adapted to receive a portion of a shredder bag thereover; adjusting the length of the bag securing mechanism to generally correspond to one side of the shredder basket; positioning the bag securing mechanism on the shredder basket; and securing a portion of the shredder bag to the bag securing mechanism on the shredder basket.

In a separate aspect, the present invention is directed to a combination bag securing mechanism and a shredder basket. The combination including a shredder basket having a base, a front side, lateral sides, and a rear side. A bag securing mechanism adapted for use with a shredder bag. The bag securing mechanism including a plurality of securing components each having lateral sides, the plurality of securing components being detachably engaged in a side-by-side fashion to form a one piece member that is reducible in length. Each securing component including a first plate adapted to be engaged with the shredder basket. A hook positioned on the first plate comprising a lip that is adapted to receive a portion of the shredder bag thereover. The bag securing mechanism is positioned on the shredder basket to secure a portion of the shredder bag thereto.

BRIEF DESCRIPTION OF THE DRAWINGS

The foregoing summary, as well as the following detailed description of the preferred embodiments of the present invention will be better understood when read in conjunction with the appended drawings. For the purpose of illustrating the invention, there are shown in the drawings embodiments which are presently preferred. It is understood, however, that the invention is not limited to the precise arrangements and instrumentalities shown. In the drawings.

DETAILED DESCRIPTION OF THE PREFERRED EMBODIMENTS

Figure 1:
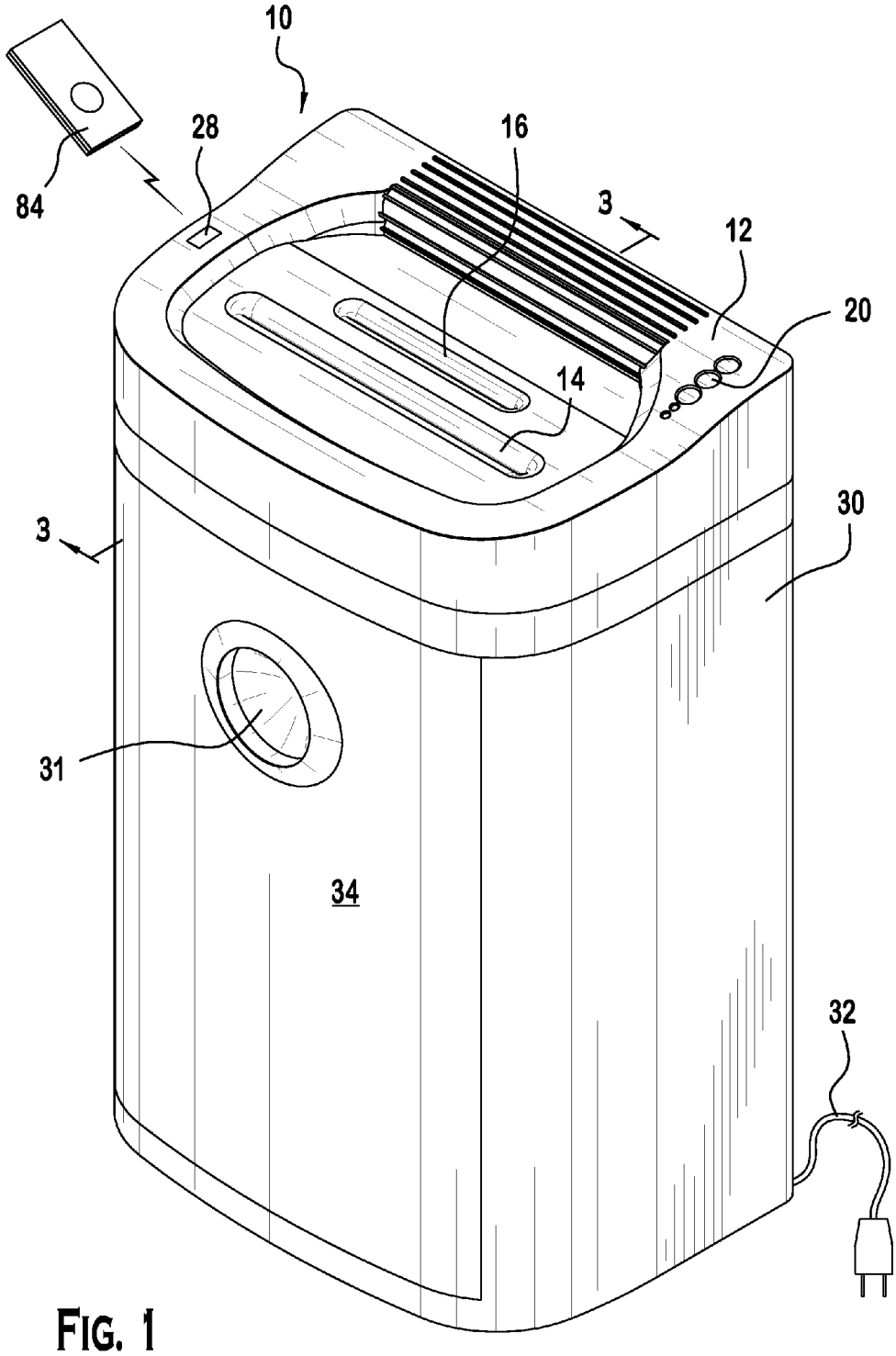
FIG. 1 is a perspective view of a shredder which includes a bag securing mechanism according to a preferred embodiment of the present invention; the bag securing mechanism allows a shredder bag to be used with the shredder basket without a portion of the shredder bag overlapping the top edge of the preferably front loading shredder basket and protruding therefrom.

Certain terminology is used in the following description for convenience only and is not limiting. The words "right," "left," "top," and "bottom" designate directions in the drawings to which reference is made. The words "inwardly" and "outwardly" refer to directions toward and away from, respectively, the geometric center of the bag securing mechanism or shredder and designated parts thereof. The term "selectable control", as used in the claims and the corresponding portions of the specification, means "any one of a physical switch, a touch switch, a button, a voice activated switch, a control knob, a remote control switch, or any other known operating mode selection device". The term "activated state", as used with selectable control, means that the selectable control has been manipulated so that the selectable control is set for a particular function. For example, if the selectable control is a simple switch, then the activated state may be having the switch turned to another position and if the selectable control is a touch sensor, then the activated state may be initiated by depressing or touching the sensor in a predetermined manner. The language "at least one of 'A', 'B', and 'C'," as used in the claims and in corresponding portions of the specification, means "any group having at least one 'A'; or any group having at least one 'B'; or any group having at least one 'C'; —and does require that a group have at least one of each of 'A', 'B', and 'C'." Additionally, the words "a" and "one" are defined as including one or more of the referenced item unless specifically stated otherwise. The terminology includes the words above specifically mentioned, derivatives thereof, and words of similar import.

Referring to FIGS. 1-9, wherein like numerals indicate like elements throughout, there are shown preferred embodiments of a bag securing mechanism 50 and/or securing component 56 which may be incorporated with a shredder 10, a shredder basket 34, a kit, or a method of the present invention. Briefly speaking, the bag securing mechanism 50 allows a portion of a shredder bag 82 to be secured thereto without having to necessarily overlap a corresponding portion of the upper edge 44, 46 of the shredder basket 34. The shredder bag 34 is preferably formed of a suitable polymer. However, the shredder bag 34 may be formed of any suitable material without departing from the scope of the present invention.

Many of the features of the shredder 10, bag securing mechanism 50, and or securing component 56 of the present invention are similar and operate in a generally similar fashion. For simplicity, some preferred embodiments will be described and, thereafter, only the differences between the described embodiments and the remaining preferred embodiments will be discussed. Accordingly, it is understood that those features discussed in connection with any one of the embodiments of the shredder 10, bag securing mechanism 50, and or securing component 56 will operate generally the same in the remaining embodiments unless otherwise described. Additionally, it is understood from this disclosure that the various features shown in the drawings and described in the specification can be interchanged or omitted without departing from the scope of the present invention.

Referring to FIG. 1, one embodiment of the present invention includes a shredder 10 with a shredder head housing 12. The shredder head housing 12 preferably defines at least one slot 14, 16 for inserting material to be shredded. The primary slot 14 guides material to be shredded to shredder blades 88 that are driven by a motor located in the shredder head housing 12. The plurality of shredder blades 88 are disposed within the shredder head housing 12 and are adapted to shred material inserted into one of the slots 14, 16. The first slot 14 is preferably used for paper documents and the second slot 16 is preferably used for more rigid documents, such as credit cards, compact discs, etc.

Referring still to FIG. 1, while the preferred shredder head housing 12 has a generally rectilinear shape, those of ordinary skill in the art will appreciate from this disclosure that the shredder head housing 12 can have any shape without departing from the scope of the present invention. The shredder head may also include a bin full indicator or other operational indicators 20. Shredder head handles may be located on the left and right lateral sides of the shredder head housing 12 to allow easy lifting of the shredder head from the shredder housing 30.

Figure 2:
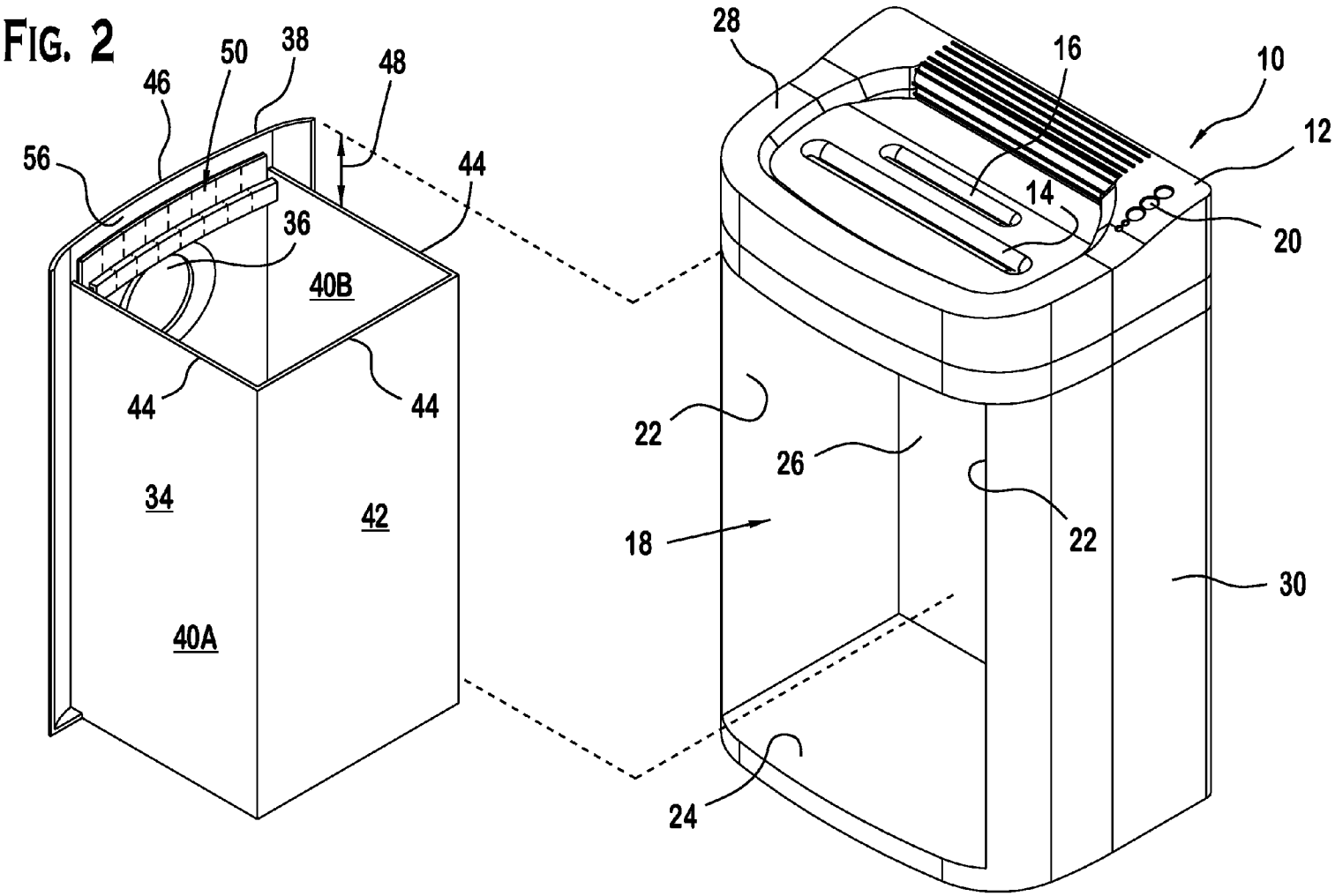
FIG. 2 is a perspective, exploded view of the shredder of FIG. 1 showing one preferred embodiment of the bag securing mechanism attached to the front side of the shredder basket; The bag securing mechanism is preferably a one piece member that is adjustable in length to correspond to an associated shredder basket; Perforations define lateral sides of some of the securing components and allow securing components to be removed if a shorter one piece member is desired; The securing members are preferably engaged with the inner, front wall of the shredder basket via an adhesive.

Referring to FIG. 2, the shredder housing 30 may define a chamber 18. The chamber 18 preferably has a rectilinear shape formed by a base 24, lateral sides 22, and a rear side 26. The shredder basket 34 is preferably removeably positioned in the chamber 18 and is adapted to receive material shredded by the shredder blades 88.

The shredder basket preferably includes first and second lateral sides 40A, 40B, a rear side 42 and a front side 44. For stylistic purposes only the front side may extend farther upwardly from the shredder basket base than the remaining basket sides 40A, 40B, 42 which results in a differential height 48 therebetween. The basket 34 may include a partially transparent section 36 to allow a user to see when the basket 34 is reaching full capacity. FIG. 1 illustrates a front side 31 of transparent section 36. Those of ordinary skill in the art will appreciate from this disclosure that although preferred embodiments of the shredder head housing 12, shredder housing 30, chamber 18, and shredder basket 34, have been described, that any suitable configuration of shredder head housing 12, shredder housing 30, chamber 18, and/or shredder basket 34 can be used without departing from the scope of the present invention.

While the preferred shredder basket 34 is generally positioned in the front of the shredder housing 30 and inserts horizontally into the housing 30, those of ordinary skill in the art will appreciate from this disclosure that the shredder basket 34 can be inserted into any side of the shredder, or inserted along any path without departing from the scope of the present invention The shredder preferably receives power from an outlet via a power conduit, such as an electrical cord, 32. However, the shredder can be powered by batteries or any other suitable power source.

Referring to FIGS. 1 and 2, the shredder 10 preferably includes a selectable control 28, such as a power switch, that is in communication with the shredder 10 and has an activated state adapted to configure the shredder 10 to automatically activate the plurality of shredder blades 88 when the material is fed into the slot 14, 16. Alternatively, the shredder may also be activated by a remote control 84 or the like.

Figure 3:
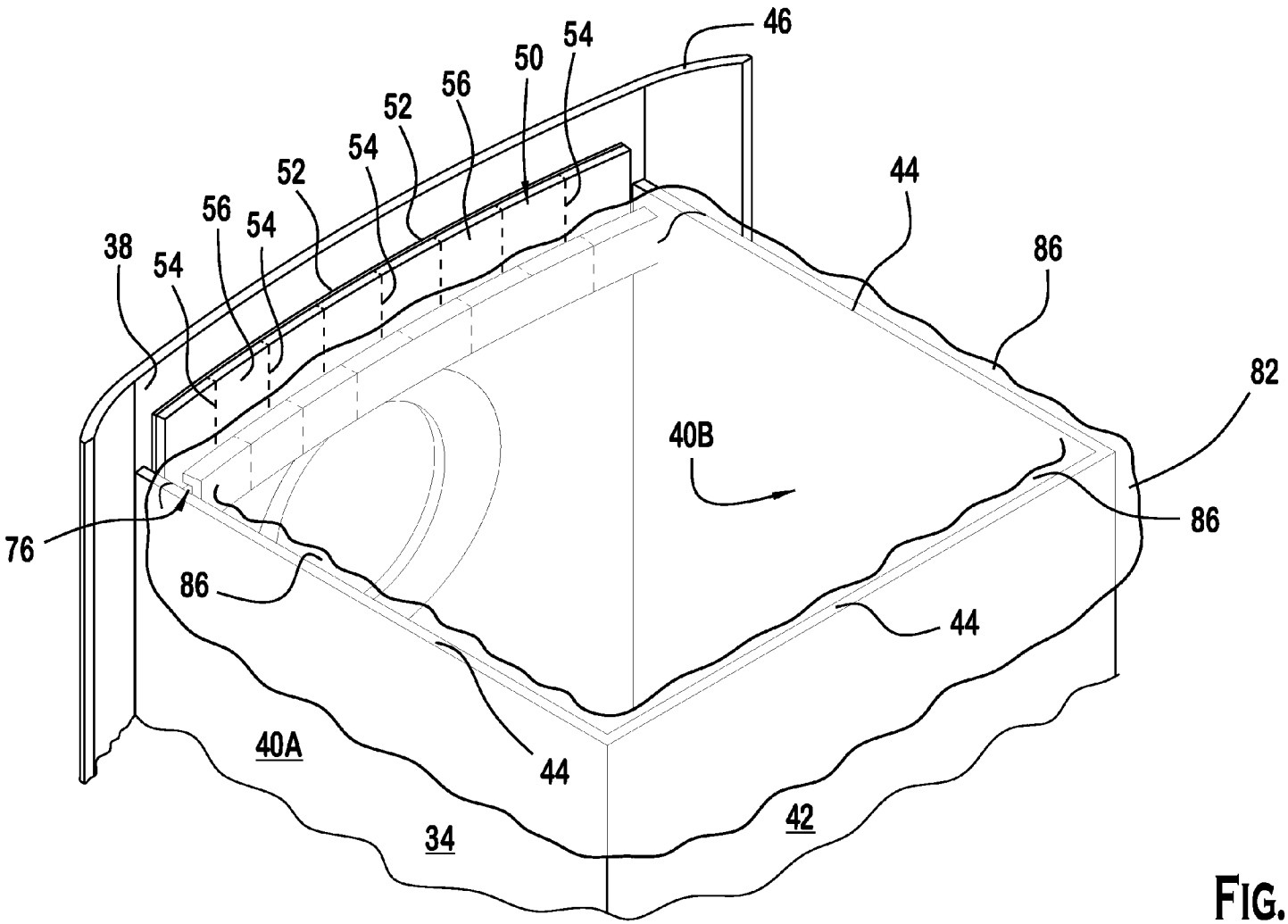
FIG. 3 is an enlarged, perspective, partial view of the shredder basket and bag securing mechanism of FIG. 2 illustrating the shredder bag attached thereto; The bag securing mechanism preferably includes securing components that each preferably have a hook positioned on a first plate that is engageable with the shredder basket; The hook preferably includes a lip that is adapted to receive a portion of a shredder bag thereover; The hook preferably includes a generally U-shaped section formed by a base, a second plate, and the lip; The base, the second plate, and the lip each preferably have a length equal to that of the first plate (as measured between the lateral sides of the securing component); The plurality of securing components are preferably adapted to allow the shredder bag to be secured along the front side of the shredder basket without having to extend over an upper edge of the front side of the shredder basket.
Figure 4:
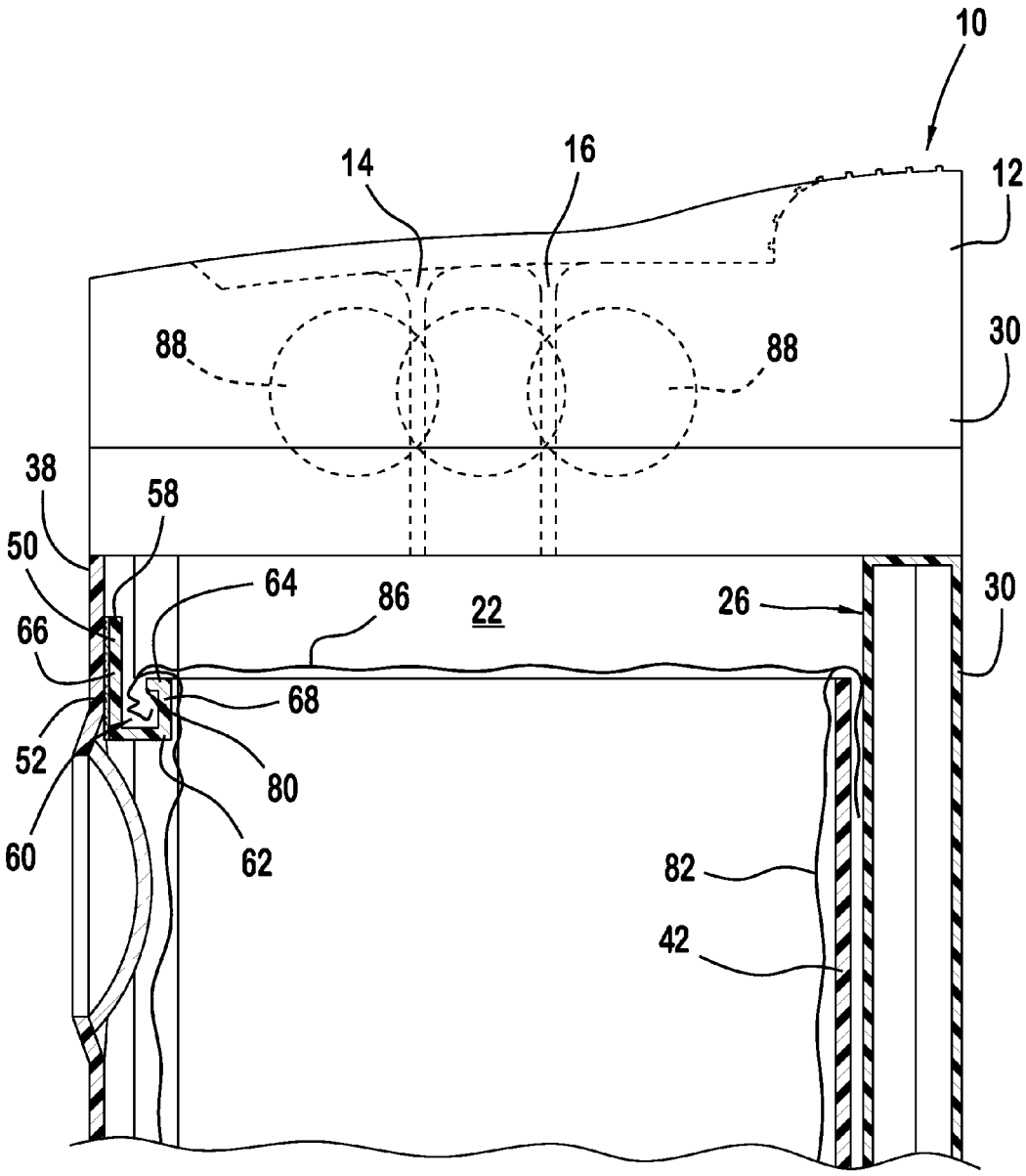
FIG. 4 is a partial cross-sectional view of the shredder and the bag securing mechanism of FIG. 2 when the shredder basket is fully engaged with the shredder with a shredder bag secured therein; The shredder basket preferably has a base, a front side, lateral sides, and a rear side, the front side may extend farther from the base than the lateral sides and the rear side; The bag securing mechanism is located proximate to an upper edge of at least one of the lateral sides and the rear side of the shredder basket to facilitate securing the shredder bag without overlapping the front side of the shredder basket.

Referring to FIGS. 2 and 3, one embodiment of the present invention is directed to a bag securing mechanism 50 adapted for use with a shredder basket 34. The bag securing mechanism 50 preferably, but not necessarily, includes a plurality of securing components 56 each having lateral sides 74. However, those of ordinary skill in the art will appreciate from this disclosure that that bag securing mechanism 50 may comprise a single securing component 56 without departing from the scope of the present invention.

Figure 5:
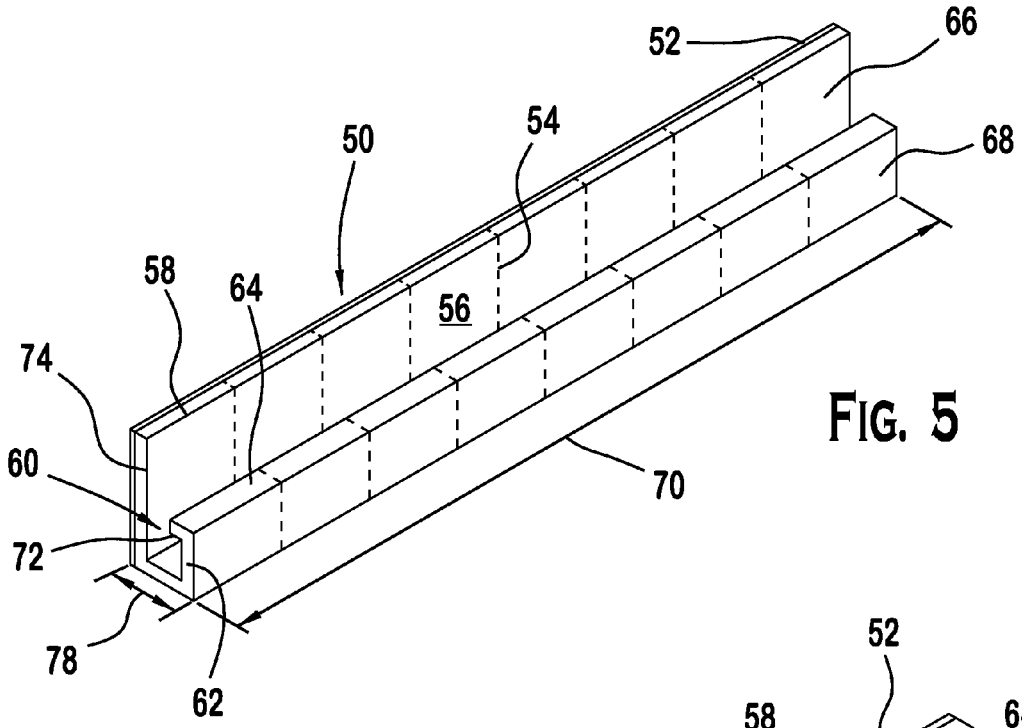
FIG. 5 is a perspective view of the bag securing mechanism of FIG. 2 illustrating a plurality of securing components detachably engaged in a side-by-side fashion to form a one piece member that is reducible in length; Adhesive is preferably placed on a side of the bag securing mechanism opposite the bag receiving hook to allow the bag receiving mechanism to be attached to an existing shredder in a retrofit manner; However, any suitable connection method can be used without departing from the scope of the present invention.
Figure 6:
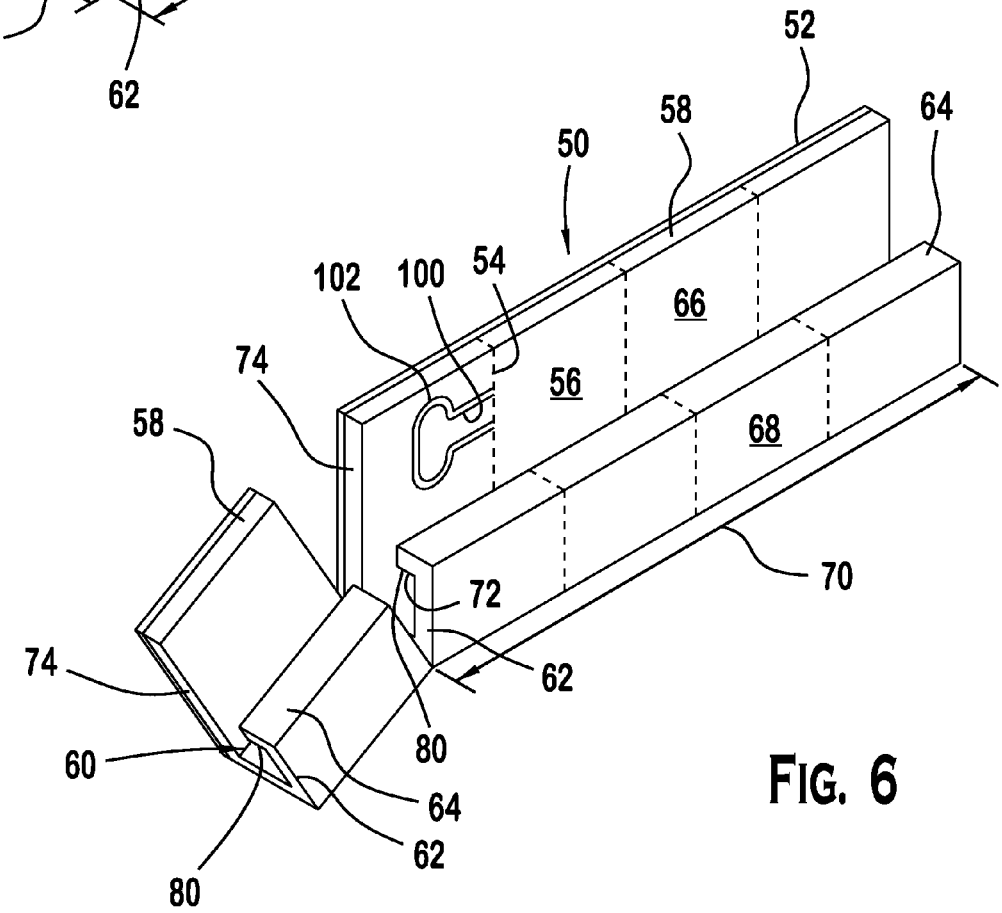
FIG. 6 is a perspective view of a bag securing mechanism similar to that shown in FIG. 5 illustrating the removal of a securing component to reduce the length of the bag securing mechanism; An interlocking mechanism is shown between two of the securing components that uses a combination projection and mating recess; Similar connection mechanisms and methods can be used to allow the bag securing member to be shortened or lengthened as desired.

Referring to FIGS. 5 and 6, the plurality of securing components 56 are preferably detachably engaged in a side-by-side fashion to form a one piece member that is adjustable (either reducible or increasable) in length 70. Referring specifically to FIG. 5, the bag securing mechanism 50 may have perforations 54 therein that define the lateral sides 74 of at least some of the plurality of securing components 56. This can allow the bag securing mechanism 50 to be shortened by removing securing components 56 by breaking the perforations 54.

The plurality of securing components 56 may be detachable and/or engageable in a side-by-side fashion depending on how they are joined together. The securing components may be attached in side-by-side fashion using a breakaway section; using an adhesive (which may be reusable), using magnets, using interlocking members (further described below), tongue and groove connections, or any other suitable connection. Depending on the type of connection between the securing members 56, the bag securing mechanisms may be able to have its length 70 increased.

Referring to FIG. 6, some of the plurality of securing components 56 may be interlocked using a combination projection 100 and mating recess 102. In this example, one securing component 56 projection has an enlarged oblong end that fits inside a mating recess 102 in an adjacent securing component 56. Alternatively, at least some of the plurality of securing components 56 may be secured in the side-by-side fashion using adhesive.

As best shown in FIGS. 5-9, each securing component 56 preferably includes a first plate 66 having an upper edge 58. It is preferred that the first plate 66 is adapted to be engaged with the shredder basket 34. The first plate 66 may be engageable with the shredder basket 34 via an adhesive 52, magnets, a snap fit, or any other suitable method of engaging the two components.

A hook 60 is positioned on the first plate 66 and preferably includes a lip 64 that is adapted to receive a portion of a shredder bag 82 thereover. The hook 60 may include a generally U-shaped section 62 formed by a base 104, a second plate 68, and the lip 64 (which may form a bag retaining surface 72). The term generally U-shaped is defined as including rectilinear corners as well as conventional smooth corners. Referring to FIG. 3, when the bag securing mechanism is positioned so that the lip 64 is just slightly higher than the first and second lateral shredder basket sides 40A, 40B, a bag trap 76 may be formed may allow a portion of the shredder bag 82 to be wedged therebetween with the shredder bag 82 wrapped about the edge 80 of the lip 64. This may allow the shredder bag 82 to be secured to all sides of the shredder basket 34 without a fold 86 being located on the upper edge of the front side 38 of the shredder basket 34.

Referring again to FIG. 5, the thickness 78 of the bag securing mechanism 50 or a securing component 56 can be varied without departing from the scope of the present invention. It is preferred, but not necessary, that the base 104, the second plate 68, and the lip 64 each have a length equal to that of the first plate 66 as measured between the lateral sides 74 of the securing component 56. This allows a single continuous hook 60 to be formed by any number of adjacent securing members 56.

Figure 7:
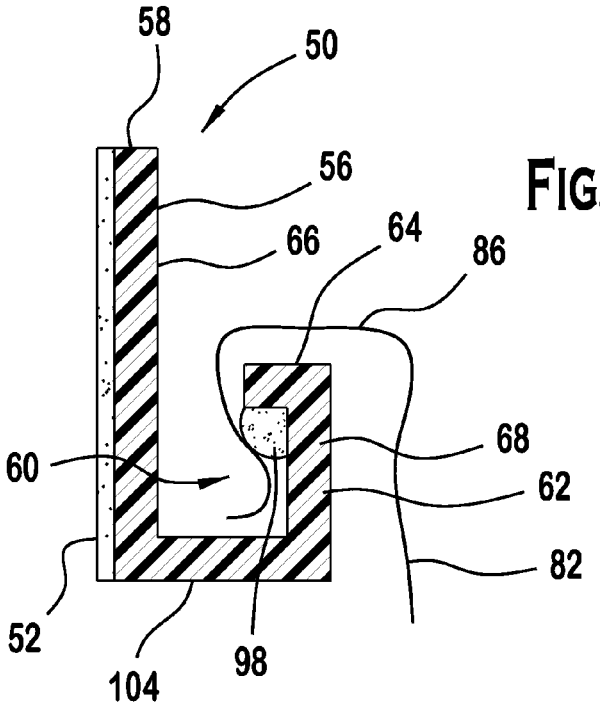
FIG. 7 is a cross-sectional view of a securing component according to another embodiment of the present invention; The hook is preferably formed by a generally U-shaped section which may include a base, a second plate, and a lip; A bag adhesive is shown positioned generally within the hook to facilitate the securing of a shredder bag therein.
Figure 8:
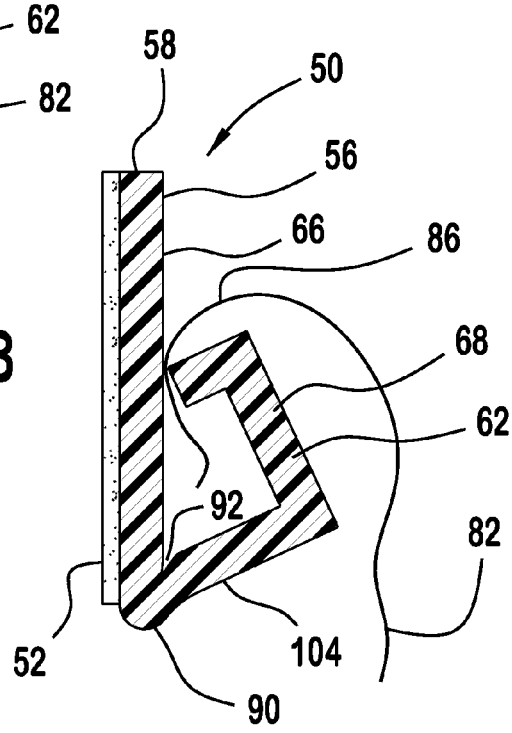
FIG. 8 is a cross-sectional view of a securing component according to another embodiment of the present invention; The hook is preferably pivotally connected to the first plate via a living hinge or any other suitable pivotal connection; A torsion spring formed by an extruded polymer biases the lip of the hook toward the first plate to secure the shredder bag therebetween; Any suitable type of torsion spring or biasing mechanism can be used without departing from the scope of the present invention.
Figure 9:
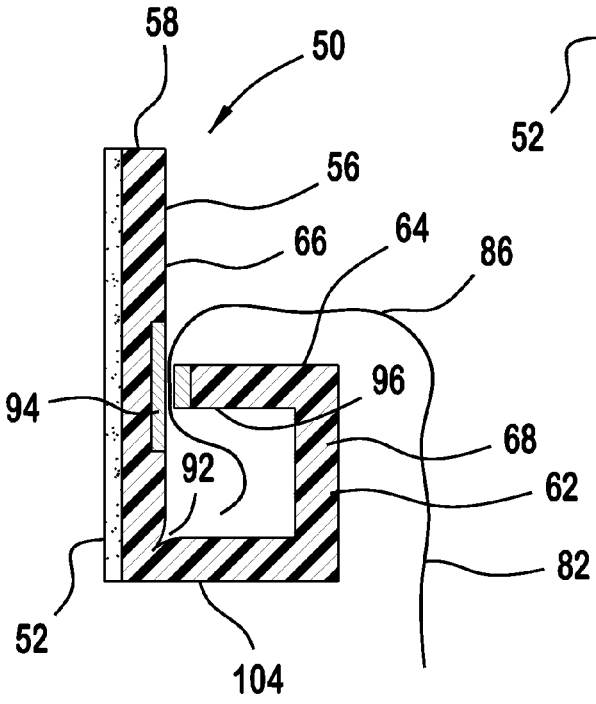
FIG. 9 is a cross-sectional view of a cross-sectional view of a securing component according to another embodiment of the present invention; The hook is preferably pivotally connected to the first plate via a living hinge or any other suitable pivotal connection; The first plate and the hook lip are maintainable in an abutting relationship using one or more magnets and/or metallic materials; This allows a user to place a portion of the shredder bag inside the hook and lift up the hook to pinch the shredder bag between the first plate and the lip.

Referring to FIG. 7, the securing component 56 may include a bag adhesive 98 located on the hook 60 to detachably secure the shredder bag thereto. Referring to FIGS. 8 and 9, the hook 60 may be pivotally secured to the first plate 66. It is preferred that the pivotal connection is formed by a living hinge 92. However, any suitable pivotal connection can be used without departing from the scope of the present invention.

Referring specifically to FIG. 8, the securing component 56 may be biased so that the lip 64 tends to rotate toward the first plate 66. It is preferred, but not necessary, that the hook 60 is biased by a torsion spring 90. The illustrated torsion spring 90 is formed by an extruded polymer. As such, the hook 60 is adapted to be manually rotated away from the first plate 66 for insertion of the shredder bag 82 therebetween so that once the shredder bag 82 is located between the hook 60 and the first plate 66, the hook 60 is automatically biased toward the first plate 66 to secure the shredder bag 82 therebetween.

Referring to FIG. 9, the first plate 66 and the hook 60 may include a combination of magnets 94 and or magnets/metallic material 96 so that when the shredder bag 82 is placed therebetween and the lip 64 is positioned proximate to the first plate 66, the securing component 56 can secure the bag 82 therein.

Referring to FIGS. 2 and 3, it is preferred that the bag securing mechanism 50 is adapted for placement on at least one side of the shredder basket 34 to secure a portion of the shredder bag 82 thereto. The securing components 56 are preferably adapted to allow the shredder bag 82 to be secured along at least one side of the shredder basket 34 without having to extend over an upper edge of the one side of the shredder basket 34. At least one of the securing components 56 may include an adhesive 52 positioned on the first plate 66 so that the bag securing mechanism 50 is adapted to engage the shredder basket 34.

The present invention is separately directed to a securing component 56 adapted for use with a shredder basket 34 that may be used alone, if desired. The securing component 56 may be adapted for placement on the shredder basket 34 to secure a portion of the shredder bag 82 thereto. The securing component 56 is preferably adapted to allow the shredder bag 82 to be secured thereto to at least reduce the amount of the shredder bag 82 that has to extend over an upper edge of the shredder basket 34.

The present invention is separately directed to a kit for use with a shredder basket 34. The kit preferably includes at least one shredder bag 82 adapted for use with the shredder basket 34. The kit also preferably includes either the bag securing mechanism 50 and/or a single securing component 56. Alternatively, the present invention is separately directed to a combination bag securing mechanism 50 and a shredder basket 34.

Multiple preferred implementations of the preferred method of the present invention will be described below (alone or in combination with various embodiments of the bag securing mechanism 50, the securing component 56, the shredder basket 34, and/or the shredder 10). The steps of the method of the present invention can be performed in any order, omitted, or combined without departing from the scope of the present invention. As such, optional or required steps described in conjunction with one implementation of the method can also be used with another implementation or omitted altogether. Additionally, unless otherwise stated, similar structure or functions described in conjunction with one method preferably, but not necessarily, operate in a generally similar manner to that described elsewhere in this application.

A first preferred method of securing at least a portion of a shredder bag 82 to a shredder basket 34 is as follows. The shredder basket 34 is provided. The shredder basket 34 may have a base, a front side 38, lateral sides 40A, 40B, and a rear side 42. The front side preferably, but not necessarily, extends farther from the base than the lateral sides 40A, 40B and the rear side 42. The bag securing mechanism 50 is preferably located proximate to an upper edge of at least one of the lateral sides 40A, 40B and the rear side 42 to facilitate securing the shredder bag 82 without overlapping the front side 38 of the shredder basket 34.

A bag securing mechanism 50 is provided that has a length that may be adjustable. The bag securing mechanism 50 is adapted to receive a portion of a shredder bag 82 thereover. The length 70 of the bag securing mechanism 50 may be adjusted to generally correspond to one side of the shredder basket 34. The bag securing mechanism 50 is positioned on the shredder basket 34 and a portion of the shredder bag 82 may be secured to the bag securing mechanism 50 on the shredder basket 34.

It is recognized by those skilled in the art that changes may be made to the above described methods and/or shredder 10 without departing from the broad inventive concept thereof. It is understood, therefore, that this invention is not limited to the particular embodiments disclosed, but is intended cover all modifications which are within the spirit and scope of the invention as defined by the above specification, the appended claims and/or shown in the attached drawings.

What is claimed is:

1. A bag securing mechanism adapted for use with a shredder basket, comprising:

a plurality of securing components each having lateral sides, the plurality of securing components being detachably engaged in a side-by-side fashion to form a one piece member that is reducible in length;

wherein each securing component comprises:

a first plate adapted to be engaged with the shredder basket;

a hook positioned on the first plate comprising a lip that is adapted to receive a portion of a shredder bag thereover;

wherein the bag securing mechanism is adapted for placement on at least one side of the shredder basket to secure a portion of the shredder bag thereto.

2. The bag securing member of claim 1, wherein the plurality of securing components are adapted to allow the shredder bag to be secured along the at least one side without having to extend over an upper edge of the at least one side of the shredder basket, at least one of the securing components further comprising an adhesive positioned on the first plate so that the bag securing mechanism is adapted to engage the shredder basket.

3. The bag securing member of claim 1, wherein the bag securing mechanism has perforations therein that define the lateral sides of at least some of the plurality of securing components.

4. The bag securing member of claim 1, wherein at least some of the plurality of securing components are interlocked using a combination projection and mating recess.

5. The bag securing member of claim 1, wherein at least some of the plurality of securing components are secured in the side-by-side fashion using adhesive.

6. The bag securing mechanism of claim 1, wherein the hook is pivotally secured to the first plate and biased so that the lip is biased toward the first plate; wherein the hook is adapted to be manually rotated away from the first plate for insertion of the shredder bag therebetween so that once the shredder bag is located between the hook and the first plate, the hook is biased toward the first plate to secure the shredder bag therebetween.

7. The bag securing mechanism of claim 1, wherein the hook comprises a generally U-shaped section formed by a base, a second plate, and the lip, the base, the second plate, and the lip each have a length equal to that of the first plate as measured between the lateral sides of the securing component.

8. A kit for use with a shredder basket, comprising:

at least one shredder bag adapted for use with the shredder basket; and a bag securing mechanism, comprising:

a plurality of securing components each having lateral sides, the plurality of securing components being detachably engaged in a side-by-side fashion to form a one piece member that is reducible in length;

wherein each securing component comprises:

a first plate;

adhesive positioned on the first plate so that the first plate is adapted to be engaged with the shredder basket;

a hook positioned on the first plate comprising a lip that is adapted to receive a portion of a shredder bag thereover;

wherein the bag securing mechanism is adapted for placement on at least one side of the shredder basket to secure a portion of the shredder bag thereto.

9. The kit of claim 8, wherein the plurality of securing components are adapted to allow the shredder bag to be secured along the at least one side without having to extend over an upper edge of the at least one side of the shredder basket.

10. The bag securing member of claim 8, wherein the bag securing mechanism has perforations therein that define the lateral sides of at least some of the plurality of securing components.

11. A combination bag securing mechanism and a shredder basket, comprising:

a shredder basket having a base, a front side, lateral sides, and a rear side;

a bag securing mechanism adapted for use with a shredder bag, the bag securing mechanism comprising:

a plurality of securing components each having lateral sides, the plurality of securing components being detachably engaged in a side-by-side fashion to form a one piece member that is reducible in length;

wherein each securing component comprises:

a first plate adapted to be engaged with the shredder basket; and a hook positioned on the first plate comprising a lip that is adapted to receive a portion of the shredder bag thereover;

wherein the bag securing mechanism is positioned on the shredder basket to secure a portion of the shredder bag thereto.

12. The combination of claim 11, wherein the front side extends farther from the base of the shredder basket than the lateral sides and the rear side, the bag securing mechanism being located proximate to an upper edge of at least one of the lateral sides and the rear side to facilitate securing the shredder bag to the shredder basket without overlapping the front side of the shredder basket.

13. The combination of claim 11, wherein the bag securing mechanism has perforations therein that define the lateral sides of at least some of the plurality of securing components.

14. The combination of claim 11, wherein the hook comprises a generally U-shaped section formed by a base, a second plate, and the lip, the base, the second plate, and the lip each have a length equal to that of the first plate as measured between the lateral sides of the securing component.

* * * * *